US005416057A

United States Patent [19]

Lipp et al.

[11] Patent Number: 5,416,057

[45] Date of Patent: May 16, 1995

[54] COATED ALTERNATING-FLOW HEAT EXCHANGES AND METHOD OF MAKING

[75] Inventors: G. Daniel Lipp, Painted Post; William J. von Hagn, Bath, both of N.Y.

[73] Assignee: Corning Incorporated, Corning, N.Y.

[21] Appl. No.: 120,396

[22] Filed: Sep. 14, 1993

[51] Int. Cl.[6] ..... B05D 7/22; B28B 11/04; B28B 11/14; C04B 41/81

[52] U.S. Cl. ..... 502/439; 165/133; 165/165; 264/62; 264/67; 422/200; 422/222; 427/230; 502/527

[58] Field of Search ..... 422/171, 173, 175, 180, 422/198, 201, 206, 222, 200; 165/133, 164–167; 427/230; 264/62, 67, 209.1; 502/439, 527

[56] References Cited

U.S. PATENT DOCUMENTS 4,041,591 8/1977 Noll et al. ..... 165/165 X
4,101,287 7/1978 Sweed et al. ..... 165/165 X
4,271,110 6/1981 Minjolle ..... 264/67
4,298,059 11/1981 Krauth et al. ..... 165/166
4,421,702 12/1983 Oda et al. ..... 264/62
4,428,758 1/1984 Montierth ..... 422/180 X
4,746,479 5/1988 Hanaki et al. ..... 264/67 X

*Primary Examiner*—Robert J. Warden
*Assistant Examiner*—L. M. Crawford
*Attorney, Agent, or Firm*—Robert L. Carlson

[57] ABSTRACT

An alternating-flow heat exchanger and method of forming is disclosed, in which a substrate is provided having open-ended, straight passageways therethrough, and at least one end cap for diverting flow in said passageways into primary and secondary flow paths. The ceramic substrate is coated with a desirable coating. The end cap is then applied to the substrate to direct flow from the passages in first and second flow paths.

13 Claims, 1 Drawing Sheet

COATED ALTERNATING-FLOW HEAT EXCHANGES AND METHOD OF MAKING

FIELD OF THE INVENTION

The present invention relates to a method for coating alternating flow heat exchangers, in particular a method for coating and catalyzing alternating-flow catalytic converter structures.

BACKGROUND OF THE INVENTION

Alternating-flow heat exchangers are heat exchangers in which gas or fluid may flow in at least two flow paths through the heat exchanger. Such heat exchangers have a variety of uses, such as, for example, as catalytic converters, furnace heat recuperators, turbine engine recuperators, and in process fluid heating or cooling. The same structure may also be used for cross-flow filters or bleed-through reactors.

Ceramic heat exchangers are typically formed by first extruding a honeycomb like body of ceramic material from a die orifice. The extrusion results in a block of ceramic material having flow channels or cells which are typically of square or other rectangular cross-section, arranged parallel and adjacent to one another along the axis of extrusion. Typically, to form alternating-flow heat exchangers, portions of the sides of the extruded block are commonly cut away to convert the original ceramic block, which originally had only straight-through passages, into one alternating between rows of straight-through flow (typically referred to as the primary flow), and rows of Z-flow, L-flow, U-flow or other similar cross directional flow (which are typically referred to as the secondary flow) through the ceramic block.

Such secondary-flow (Z-flow, L-flow, etc.) channels are commonly made by sawing into the sides of some of the channels in the ceramic block and afterwards sealing the ends of these channels, thereby forming the secondary-flow channels. Examples of methods which utilize sawing techniques to form Z-flow alternating-flow heat exchangers are disclosed in U.S. Pat. No. 4,271,110 to Minjolle, and U.S. Pat. No. 4,421,702 to Oda et al. U.S. Pat. No. 4,298,059 to Krauth et al. discloses a similar sawing method, wherein diamond cutting wheels are used to saw slots into an extruded body, after which time the ends of the slots are plugged to form an L-flow alternating-flow heat exchanger in which both flow paths through the heat exchanger follow an L-shaped path.

Thin-walled honeycomb substrates find extensive use as catalyst supports (such as in catalytic converters) where a honeycombed substrate is coated with a thin film having a high surface area, active metal oxide such as gamma alumina. Various techniques have been utilized to coat such substrates, including spraying and dipping, as disclosed in U.S. Pat. No. 3,565,830 to Keith et al. It is difficult to apply a uniform, thin coating even to conventional honeycomb substrates, as these substrates often are characterized by 200 or more cells per square inch (31 cells per square cm), with cells walls less than 0.02 inch (0.05 cm) thick. These difficulties are greatly magnified when the conventional honeycomb substrate is modified to be an alternating flow heat exchanger such as the L-flow, Z-flow, and U-flow devices described above, because of the non-straight secondary flow paths of such devices. The coating material has a tendency to collect at every turn or elbow in such non-straight flow paths. Further, in structures having non-straight flow paths, one cannot look from one end of the flow path to the other in such devices, making inspection of such devices (after washcoating) extremely difficult.

In many applications which utilize alternating flow devices, such as catalyst support applications, the objective is to maximize the overall surface area at which reactions can be promoted by a catalyst such as platinum. Consequently, uniform coating of the cell wall is important. If a coating is non-uniform, the efficiency of the catalyst device is reduced. The application of such uniform coatings can be very difficult in alternating flow structures, especially those having sharp directional turns (such as L-flow, Z-flow, or U-flow), as washcoat material can collect in these turns and lead to plugging of these paths. Such plugging greatly deteriorates the efficiency of the catalyst.

Thus, there is a need for a more efficient method to washcoat and/or catalyze alternating-flow heat exchangers having non-straight passageways. Preferably, such a method would also facilitate inspection of the washcoated or catalyzed product.

SUMMARY OF THE INVENTION

One aspect of the present invention relates to a method of making a coated, alternating flow structure, the method comprising:

providing a structure having at least one side and two opposite ends, said structure comprising a plurality of straight, parallel flow passages extending between said opposite ends;

coating said structure; and diverting flow from selected passages in said structure using at least one end cap, said at least one end cap having passages which correspond to said passages in said structure, some of said end cap passages having plugged portions therein.

Another aspect of the present invention relates to a method for coating the walls of an alternating-flow heat exchanger structure, the method comprising:

providing an alternating flow structure having at least one side and two opposite ends, said structure having a plurality of straight parallel passages, a plurality of said passages being plugged;

cutting said structure to form a substrate section having open ended passages, and at least one end cap section having a plurality of plugged passages; and coating the passages of said substrate section.

Another aspect of the present invention relates to an alternating-flow structure comprising:

a first section having a plurality of first and second flow passages having straight passage sections extending longitudinally from one end of the substrate to the other; and at least one end cap, said end cap, when positioned appropriately against said first section, causing flow from the second passages to travel in a different path shape or direction than flow from the first flow passages.

The methods and apparatus of the present invention have numerous advantages over prior art methods for coating alternating-flow heat exchangers.

By exposing straight-through passageways in the substrate section, coating of the substrate section is greatly facilitated, as it is much easier to coat a straight passageway than a passageway which is not straight.

Further, manual line-of-sight inspection of the coated structure is possible. This greatly facilitates the inspection process compared to prior art methods, as line-of-sight inspection is obviously not possible through the non-straight secondary passageways such as Z-flow or U-flow passageways, in typical alternating-flow heat exchangers.

DETAILED DESCRIPTION OF THE DRAWINGS

Figure 1:
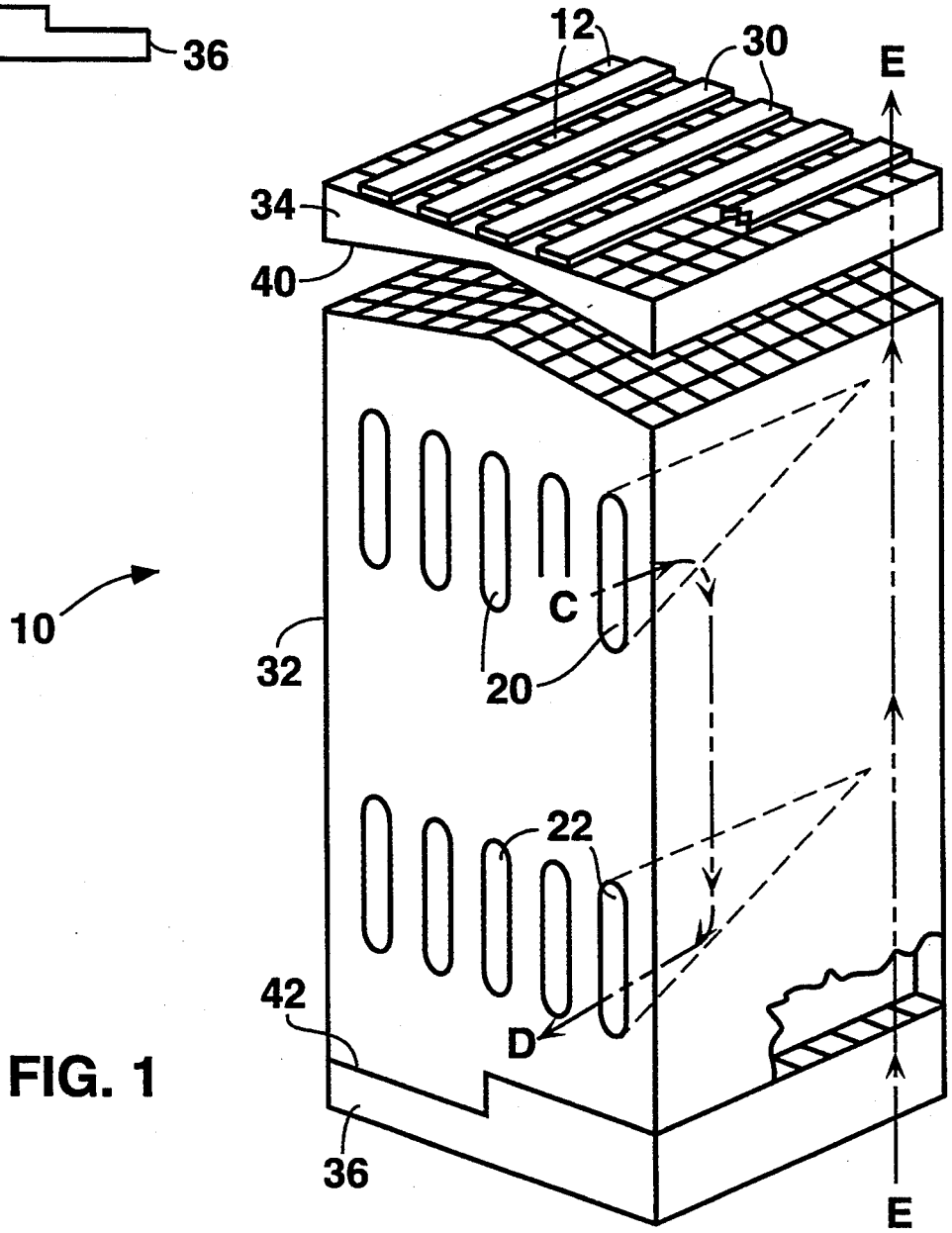
FIG. 1 is a perspective view of an extruded ceramic body in accordance with the present invention, having straight primary flow passages and non-straight secondary flow passages, and two end caps.

FIG. 1 illustrates a perspective view of an alternating flow heat exchanger structure 10 having a plurality of straight-through flow passages 12, each of the flow passages being parallel to one another and extending between opposite ends of the ceramic body. The fluid flow passages in ceramic structure 10 include primary flow passages, which direct fluid in a straight path (as indicated by directional arrow E), and U-shaped secondary flow passages which direct fluid flow in a non-straight path through side-drilled orifices 20 and 22 (as indicated by directional arrow C–D). The ends of selected passages in ceramic body 10 are selectively plugged by an appropriate plugging material 30 to divert flow through the secondary flow passages.

In accordance with the present invention, to facilitate coating operations, such as washcoating and/or catalyzing, especially of the secondary flow passages, ceramic body 10 is separated into a substrate section 32 and one or more cap sections 34 and 36. Providing a substrate section 32 and separate cap sections 34 and 36 facilitates coating of passageways in structure 10, because all of the passages in substrate section 32 are straight and open-ended, even those which form the secondary flow passages.

In the embodiment illustrated in FIG. 1, ceramic body 10 was produced using an extrusion technique, which is the preferred method of manufacturing the initial ceramic body. However, other methods could also be used to make these and similar structures, such as, for example, laying up alternating flat and corrugated layers of metal or ceramic materials. The passages 12 of ceramic body 10 in FIG. 1 are of square cross-section. However, other cell shapes could also be employed, such as, for example, triangular or rectangular.

Ceramic body 10 in FIG. 1 has been modified to be an alternating-flow heat exchanger having a plurality of alternating primary and secondary flow passages. The designation of these flow passages as primary and secondary is random and interchangeable. However, for purposes of explanation herein, in structures which have entirely straight passageways, such passageways shall be referred to as the primary flow passages. The alternating-flow heat exchanger illustrated in FIG. 1 is a U-flow alternating-flow heat exchanger. The primary fluid flow passages direct fluid flow in a straight path, as indicated by arrow E, through open-ended channels 12 of ceramic body 10. The secondary fluid flow passages direct fluid flow in a U-shaped path, as indicated by the U-shaped path C–D.

In the embodiment illustrated in FIG. 1, side passageways or orifices 20 and 22 combine with a plurality of the straight-through flow passage sections 12 of the original extruded body 10 to form the U-shaped secondary flow path. Side passageways 20 and 22 are preferably formed using a drilling technique, such as is disclosed in U.S. Pat. No. 5,373,634, the specification of which is hereby incorporated by reference. Alternatively, side passageways 20 and 22 could be formed using sawing methods such as are disclosed in U.S. Pat. Nos. 4,271,110; 4,421,702; and 4,298,059, discussed hereinbefore. Such sawing techniques are not preferred, however, because they remove material between passages at the end of the ceramic structure, resulting in a weakening of the ceramic structure. Drilling techniques, on the other hand, can be used to form holes or tunnel-like passageways, such as are illustrated by 20 and 22 in FIG. 1.

To complete formation of the alternating-flow heat exchanger, the open ends of the channels 12 which communicate with side-drilled passageways 20 and 22 are plugged to prevent fluid from escaping therefrom. In a preferred method of the present invention, this is achieved by plugging the end orifices of selected channels 12 in end caps 34 and 36 using a suitable plugging material 30, and then applying the end caps to the opposite ends of substrate 32, or indicated by directional arrows A and B in FIG. 2. The thickness of plugging material 30 shown in FIG. 1 is exaggerated for purposes of illustration. In most applications, it is preferable that the plugging material merely fill-in and plug the openings of desired channels, without extending outwardly from the end of the ceramic body. Suitable methods and materials for plugging the ends of extruded ceramic bodies are well-known in the art. Such methods are explained, for example, in U.S. Pat. Nos. 5,021,204 to Frost et al. and 4,752,516 to Montierth, the specifications of which are hereby incorporated by reference. Preferable materials for plugging include the same material used to make the extruded body (preferred materials are listed herein), mixed with colloidal silica or other suitable binders, as well as ceramic commercial cements, such as those manufactured by the Sauereisen Cements Company of Pittsburgh, Pa.

By appropriately plugging both ends of the passageways which communicate with side passageways 20 and 22, a plurality of U-shaped secondary-flow passageways are produced. Consequently, the primary flow direction of the first fluid enters the heat exchanger unit parallel to its axis through straight-through flow channels 12 and flows in a straight path in the direction indicated by arrow E. The second fluid follows a U-shaped path, entering the heat exchanger unit perpendicular to the axis of extrusion in the direction of arrow C via the orifices 20, flowing through the straight through secondary passages towards the orifices 22, and out through orifices 22 in the direction of arrow D. Of course, the U-flow path could also be in the opposite direction, namely, into orifice 22 and out of orifice 20. Also, the method of the present invention is not limited to coating alternating flow structures having U-shaped secondary flow channels, but could also be used to coat structures having Z-shaped, L-shaped, and other shaped channels.

A preferred application for alternating-flow heat exchangers is as a catalytic converter in an exhaust gas system. In such applications, where catalysis of cold side or hot side gases is appropriate, the heat exchangers must be washcoated and catalyzed. Washcoating involves coating the inside of the flow channels with a slurry, typically of $Al_2O_3$ particles, to increase surface area of the structure to promote and enhance catalytic activity. Catalyzing typically involves coating noble metal catalysts onto the oxide support materials (left by washcoating) by contacting the heat exchangers with an aqueous alkaline solution containing the noble metal cations.

As mentioned above, to facilitate washcoating and/or catalyzing of the alternating-flow heat exchanger, the structure is separated (or manufactured) into two or more sections, namely, a substrate section 32 and one or more cap or end piece sections 34 and 36. The separate substrate and cap sections can be formed using various methods. For example, a conventional extruded heat exchanger 10 which has been modified into an alternating flow device can be cut appropriately using a suitable cutting or sawing device. By cutting the ceramic body into a substrate 32 and two plugged end pieces 34 and 36, substrate section 32 is provided with two new ends, each of which have only open-ended straight flow passages. Of course, the substrate and cap sections could also be manufacture separately.

Because all of the passages in substrate section 32 have open ends and straight channel sections, the washcoating and catalyzing processes are more easily conducted and controlled. The straight, open-ended flow paths greatly facilitate and increase the speed with which these processes can be achieved. Inspection is likewise facilitated, since visual inspection is possible through the straight flow paths.

After washcoating and/or catalyzing of the substrate section 32, the end caps 34 and 36 are reattached or retained against the substrate section 32 to form a complete alternating-flow heat exchanger 10, the substrate section 32 of which is catalyzed. The end caps 34 and/or 36 are retained against substrate section 32 using conventional "canning" techniques such as are used to mount conventional catalytic converters within metal support structures. Such techniques are well known in the art.

When side orifices such as 20 and/or 22 are utilized in the exchanger 10, they are preferably formed prior to the washcoating and catalyzing operations to minimize waste of the materials used in the washcoating and catalyzing processes.

When used in applications such as catalytic converter applications, and the end cap includes passages which directly correspond to the passages in the substrate section, it is important to be able to maintain accurate alignment of the end cap and substrate.

To facilitate the accurate placement of the end caps 34 and 36 against substrate section 32, so that the corresponding passages of the end caps 34 and 36 align with those of substrate section 32, the end caps are preferably cut in a non-planar fashion. For example, in the heat exchanger of FIG. 1, interfaces 40 and 42 of substrate section 32 were cut in an angled and stair-step pattern, respectively. Of course, while heat exchanger illustrated has two different shaped interfaces 40 and 42, it is more likely that one would employ the same shape (i.e., angled or stair-step) for both interface 40 and 42. Alternatively, alignment rods (not shown) could be utilized, which extend from the substrate section 32 into the end caps 34 and 36, or from the end caps 34 and 36 into the substrate section 32.

Plugging of the ends of the alternating-flow channels can take place either before or after washcoating and/or catalyzing of the substrate section. However, to facilitate the manufacturing operation, it is preferable to plug and fire the ceramic body prior to washcoating. In one preferred embodiment, a conventional ceramic heat exchanger body is extruded and dried. Appropriate side-drilled passageways 20 and 22 are then made into the body which communicate with selected passageways to form U-shaped secondary flow passages. The ends of these selected passageways are then plugged, and the body is fired for a time and temperature which is sufficient to form a ceramic body. This results in a fired, ceramic, alternating flow heat exchanger. The ends of this fired body are then cut off to form a substrate section 32 and two end caps 34 and 36. Substrate section 32 is washcoated and catalyzed. The substrate 32 and end caps 34 and 36 are then retained in a metal housing to form an alternating flow catalytic converter structure.

Figure 2:
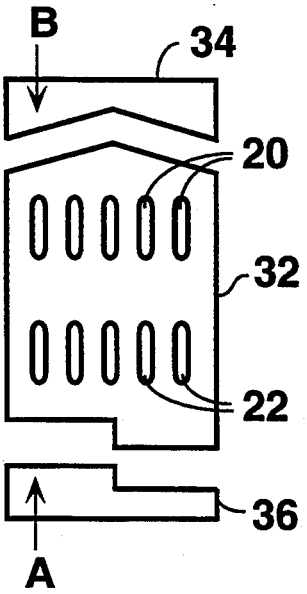
FIG. 2 is a side view of the heat exchanger shown in FIG. 1, illustrating application of the end caps to the substrate portion.

In the embodiments illustrated in FIGS. 1 and 2, passageways 20 and 22 were drilled so that they resulted in relatively narrow passageways having a width of one flow channel. However, if desired, passageways 20 and 22 could be drilled to be two, three or more channels thick. Also, in FIGS. 1 and 2, side drilled passageways 20 and 22 are not drilled completely through to the opposite side of ceramic body 10. Consequently, a single input manifold and a single exhaust manifold can be employed to channel fluid into channels 20 and out of channels 22, respectively. However, channels 20 and 22 could alternatively be drilled completely through heat exchanger 10, in which case double input and exhaust manifolds could be utilized. In addition, channels 20 and 22 as illustrated have triangular cross-sections. However, alternatively, in the heat exchangers of the present invention, both of channels 20 and 22 could be rectangular, or triangular, or various combinations of different shaped cross-sections.

A preferred forming material for the heat exchanger, especially when the heat exchanger is used as a catalytic converter, is cordierite. However, a variety of other useful ceramic materials, such as, for example, silicon nitride, silicon carbide, lithium alumino-silicate, mullite, zircon, and so forth, as well as non-ceramic materials, such as glass-ceramics, glasses, metals, cermets, polymers and other organic materials, and so forth, could also be employed. It should be noted, however, that this list is not all-inclusive, and other alternative materials could also be employed.

Applications for the alternating flow structures of the present invention are not limited to catalytic converters in exhaust systems, but could also be, for example, furnace heat recuperators, turbine engine recuperators, process fluid heating or cooling devices, filters or bleed-through reactors. Similarly, the fluids transportable through these heat exchangers are not limited to gases, and therefore alternative cooling or heating fluids such as heat transfer oil, and so forth, could be utilized.

The invention may be more easily comprehended by reference to the following specific example. However, this example is provided solely for purposes of illustration, and it should be understood that the invention may be practiced otherwise than as specifically illustrated without departing from its spirit and scope.

EXAMPLE

Several 1000 g batches of dry powders are made of the components clay, talc and aluminum oxide as raw materials for subsequent formation of a cordierite honeycomb. The raw material batches are each mixed with methyl cellulose as a binder and sodium stearate as a lubricant for the subsequent extrusion operation. The raw materials methyl cellulose and sodium stearate are mixed in a Littleford mixer for about 3 minutes in order to obtain a homogeneous dry blend. The batch is then transferred to a plasticizing mixer such as a muller, sigma blade mixer, etc. and water is added to the dry components in an amount sufficient to form a plasticized batch. The resulting mix is blended for about 10–15 minutes to make a plastic mixture. A relatively square cross-section (about 70 mm×70 mm), green honeycomb body is then extruded, having square cells, at about 16 cells/$cm^2$ (corresponding to a cell cross-sectional area of about 6 $mm^2$) and having a cell wall thickness of about 0.5 mm. The honeycomb structure has a length of about 250 mm.

The honeycomb body is then dried. A plurality of channels 20 having a width of about 1.7 mm, a length of about 10 mm, and a depth of about 40 mm are milled into the extruded body to form secondary flow channels. The channels 20 are located about 20 mm from one end of the extruded body. By directing the knife straight into the body at a 90 degree angle, and keeping the knife positioned between adjacent cell walls, the knife opens the side cell walls of selected single rows of channels. This procedure is repeated in every other row of channels across the entire structure, so that the structure alternates between rows of straight-through flow channel, which are unchanged from their extruded state, and rows of channels which are connected to transverse passageways 20 created by the knife. A similar set of rectangular passages 22 is cut, on the same side of the extruded body, and into the same channels, but starting 10 mm from the other end of the extruded body, thereby forming a plurality of U-flow secondary flow channels having rectangular passages or orifices 20 and 22, as was discussed above. At this point, each end of the resultant body is essentially unchanged from the ends that existed as initially extruded.

The ends of the selected secondary flow channels are then plugged by applying a slurry mixture, consisting of water and the extrusion batch material, to fill and/or cover the ends of each of the channels in the selected rows.

The green structure is then fired by heating to a temperature of about 1430° C. over a period of about 41 hours and maintaining that temperature for about 10 hours.

After firing, the resultant ceramic body is cut in an axial direction, to separate the body into one substrate section and two end caps. The end caps are each cut off between the end of the body and the side-drilled passageways 20 and 22 at each respective end. This results in the substrate section having completely straight channels, both ends of which are open. This substrate section is then washcoated and catalyzed, using conventional washcoating and catalyzing techniques known in the art.

The end caps and substrate are then retained against one another in a suitable metal housing, in much the same way that conventional catalytic converters are housed.

Although the invention has been described in detail for the purpose of illustration, it is understood that such detail is solely for that purpose and that variations can be made therein by those skilled in the art without departing from the spirit and scope of the invention.

What is claimed is:

1. A method for coating the walls of an alternating-flow heat exchanger structure, said method comprising:

providing an alternating flow structure having at least one side and two opposite ends, said structure having a plurality of straight parallel passages, a plurality of said passages being plugged;

cutting said structure into sections to form a substrate section having open ended passages, and an end cap section having a plurality of plugged passages; and coating the passages of said substrate section.

2. The method of claim 1, wherein said coating comprises applying a coating material to said substrate through said end formed by said cutting step.

3. A method of forming a coated alternating flow structure according to claim 1, further comprising retaining said end cap against said substrate to block flow from selected passages of said substrate.

4. The method of claim 1, wherein said provided structure comprises at least one side orifice in said structure said orifice communicating with at least some of the passages whose ends are plugged.

5. The method of claim 4, wherein said cutting step comprises cutting the structure substantially axially through said structure, said cutting occurring between said plugged end and said at least one side orifice.

6. The method of claim 5, wherein said cutting comprises a non-planar cut through said structure.

7. The method of claim 1, wherein said structure in said providing step comprises an extruded body.

8. The method of claim 1, wherein said structure is composed of a material selected from the group consisting of ceramic, glass-ceramic, glass, metal, cermet, and polymeric materials.

9. The method of claim 8, wherein said structure is composed of a ceramic material selected from the group consisting of cordierite, lithium alumino-silicate, silicon carbide, silicon nitride, mullite and zircon.

10. A method of forming an alternating-flow heat exchanger according to claim 1, wherein said structure in the providing step comprises passages which are plugged at both ends of said structure, and said cutting step comprises: cutting off both ends of said structure to form a substrate section and two end caps.

11. The method of claim 1, wherein said alternating flow structure in said providing step comprises side flow passages in at least one of said at least one side, said side flow passages in communication with a plurality of said straight parallel passages.

12. The method of claim 1, further comprising, prior to said cutting step, firing said structure.

13. The method of claim 1, further comprising, after said cutting step and prior to said coating step, firing said substrate and end cap sections.

* * * * *